United States Patent [19]

Capek et al.

[11] Patent Number: 4,891,544

[45] Date of Patent: Jan. 2, 1990

[54] FRONT ASSEMBLY FOR A TENSION MASK COLOR CATHODE RAY TUBE HAVING A PRE-SIZED MASK SUPPORT STRUCTURE

[75] Inventors: Raymond G. Capek, Elmhurst; Lawrence W. Dougherty, Sleepy Hollow; James L. Kraner, Barrington, all of Ill.

[73] Assignee: Zenith Electronics Corporation, Glenview, Ill.

[21] Appl. No.: 234,450

[22] Filed: Aug. 19, 1988

[51] Int. Cl.[4] ..... H01J 29/07; H01J 9/18

[52] U.S. Cl. ..... 313/402; 313/407; 445/30; 445/37

[58] Field of Search ..... 313/402, 407, 408; 445/30, 37, 47, 68

[56] References Cited

U.S. PATENT DOCUMENTS

| | | | |
|---|---|---|---|
| 3,894,321 | 7/1975 | Moore | 313/402 |
| 4,121,131 | 10/1978 | van Esdonk et al. | 445/37 X |
| 4,730,143 | 3/1988 | Fendley | 313/402 X |
| 4,739,217 | 4/1988 | Fendley et al. | 313/407 |

*Primary Examiner*—Palmer C. DeMeo
*Assistant Examiner*—Sandra L. O'Shea

[57] ABSTRACT

A faceplate assembly for a color cathode ray tube is disclosed that includes a glass faceplate having on its inner surface a centrally disposed phosphor screen. A foil shadow mask is mounted in tension on a mask-support structure of tightly controlled uniform height located on opposed sides of the screen and secured to the inner surface by a devitrified solder glass. The assembly according to the invention has a plurality of spacing elements of tightly controlled uniform height located between the support structure and the inner surface of the faceplate, and extending through the solder glass to provide intimate contact with the inner surface. The tightly controlled uniform heights of the support structure and the spacing elements provide for tightly controlled uniform spacing between the mask and screen throughout the length of the support structure. A process for manufacturing a faceplate assembly according to the invention is also disclosed.

20 Claims, 3 Drawing Sheets

FRONT ASSEMBLY FOR A TENSION MASK COLOR CATHODE RAY TUBE HAVING A PRE-SIZED MASK SUPPORT STRUCTURE

CROSS-REFERENCE TO RELATED APPLICATIONS AND PATENTS

This application is related to but in no way dependent upon copending applications Ser. No. 832,493 filed Feb. 21, 1986, now U.S. Pat. No. 4,701,678; Ser. No. 832,556 filed Feb. 21, 1986, now U.S. Pat. No. 4,695,761; Ser. No. 866,030 filed May 21, 1986, now U.S. Pat. No. 4,737,681; Ser. No. 923,924 filed Oct. 28, 1986, now U.S. Pat. No. 4,783,614; Ser. No. 058,095 filed June 4, 1987, now U.S. Pat. No. 4,828,523; and Ser. No. 140,164 filed Mar. 4, 1988, all of common ownership herewith.

BACKGROUND OF THE INVENTION

1. Field of the Invention

This invention relates to color cathode ray picture tubes, and is addressed specifically to an improved front assembly for color tubes having shadow masks of the tension foil type in association with a substantially flat faceplate. The invention is useful in color tubes of various types, including those used in home entertainment television receivers, and in medium-resolution and high-resolution tubes intended for color monitors.

The use of the foil-type flat tension mask and flat faceplate provides many benefits in comparison to the conventional domed shadow mask and correlatively curved faceplate. Chief among these is a greater power-handling capability which makes possible as much as a three-fold increase in brightness. The conventional curved shadow mask, which is not under tension, tends to "dome" in picture areas of high brightness where the intensity of the electron beam bombardment is greatest. Color impurities result as the mask moves closer to the faceplate, and as the beam-passing apertures move out of registration with their associated phosphor elements on the faceplate. When heated, the tension mask distorts in a manner quite different from that of the conventional mask. If the entire mask is heated uniformly, there is no doming and no distortion until tension is completely lost; just before that point, wrinkling may occur in the corners. If only portions of the mask are heated, those portions expand, and the unheated portions contract, resulting in displacements within the plane of the mask; i.e., the mask remains flat.

The tension foil shadow mask is a part of the cathode ray tube front assembly, and is located in close adjacency to the faceplate. The front assembly comprises the faceplate with its screen consisting of deposits of light-emitting phosphors, a shadow mask, and support means for the mask. As used herein, the term "shadow mask" means an apertured metallic foil which may, by way of example, be about 0.001 inch thick, or less. The mask must be supported in high tension a predetermined distance from the inner surface of the cathode ray tube faceplate; this distance is known as the "Q-distance." As is well known in the art, the shadow mask acts as a color-selection electrode, or parallax barrier, which ensures that each of the three beams generated by the electron gun located in the neck of the tube lands only on its assigned phosphor deposits.

The requirements for a support means for a foil shadow masks mask are stringent. As has been noted, the foil shadow mask is normally mounted under high tension; e.g., 30 lb/inch. The support means must be of high rigidity so the mask is held immovable; an inward movement of the mask of as little as 0.0002 inch can cause the loss of guard band. Also, it is desirable that the shadow mask support means be of such configuration and material composition as to be compatible with the means to which it is attached. As an example, if the support means is attached to glass, such as the glass of the inner surface of the faceplate, the support means must have a coefficient of thermal contraction compatible with that of the glass, and by its composition, be bondable to glass. Also, the support means must be of such composition and structure that the mask can be secured to it by production-worthy techniques such as electrical resistance welding or laser welding. Further, it is essential that the support means provide a suitable surface for mounting and securing the mask. The material of which the support structure is composed must be adaptable to machining or to other forms of shaping so the structure can be contoured into near-perfect flatness. Otherwise, voids will exist between the metal of the mask and the support structure, preventing positive, uniform contact of the mask to the support structure necessary for proper mask securement.

Means for securing the shadow mask support to the inner surface of the faceplate may comprise a cement in the form of a devitrifying solder glass, also known as "frit."

2. Prior Art

In U.S. Pat. No. 3,894,321 to Moore, of common ownership herewith, there is disclosed means for mounting a foil shadow mask on "rails" which extend from the faceplate. In another embodiment, the faceplate is shown as having an inner ledge that forms a continuous path around the tube, the top surface of which is a Q-distance away from the faceplate for receiving a foil mask.

In referent application Ser. No. 140,464 of common ownership herewith, an apparatus and process is disclosed for forming a mask-receiving surface on a foil mask-support structure in which all points on the surface are in a plane parallel to, and at a specified distance from, the plane of the inner surface of the faceplate. Also disclosed are means for positioning the inner surface of the faceplate relative to a known reference plane, means for clamping the panel without damage to the glass, and means for removing material from the mask-receiving surface to produce a smooth and burr-free planar surface precisely parallel to the reference plane.

OBJECTS OF THE INVENTION

It is a general object of the invention to provide an improved apparatus and process for use in the manufacture of the faceplate assembly of a color cathode ray tube having a tensed foil shadow mask and a substantially flat faceplate.

It is an object of the invention to provide an improved support structure and process for mounting a foil shadow mask in tension in association with a substantially flat faceplate.

It is another object of this invention to provide a process for use in the manufacture of tension mask faceplate assemblies that simplifies manufacture and reduces manufacturing costs.

It is another object of the invention to provide a front assembly having a foil mask support structure that does not require sizing after installation on the faceplate.

It is yet another object of the invention to provide a means and process for establishing and maintaining tightly controlled uniform spacing between a shadow mask and a screen in flat tension mask tubes.

BRIEF DESCRIPTION OF THE DRAWINGS

The features of the present invention which are believed to be novel are set forth with particularity in the appended claims. The invention, together with further objects and advantages thereof, may be best understood by reference to the following description taken in conjunction with the accompanying drawings (not to scale), in the several figures of which like reference numerals identify like elements, and in which:

DESCRIPTION OF THE PREFERRED EMBODIMENT

Figure 1:
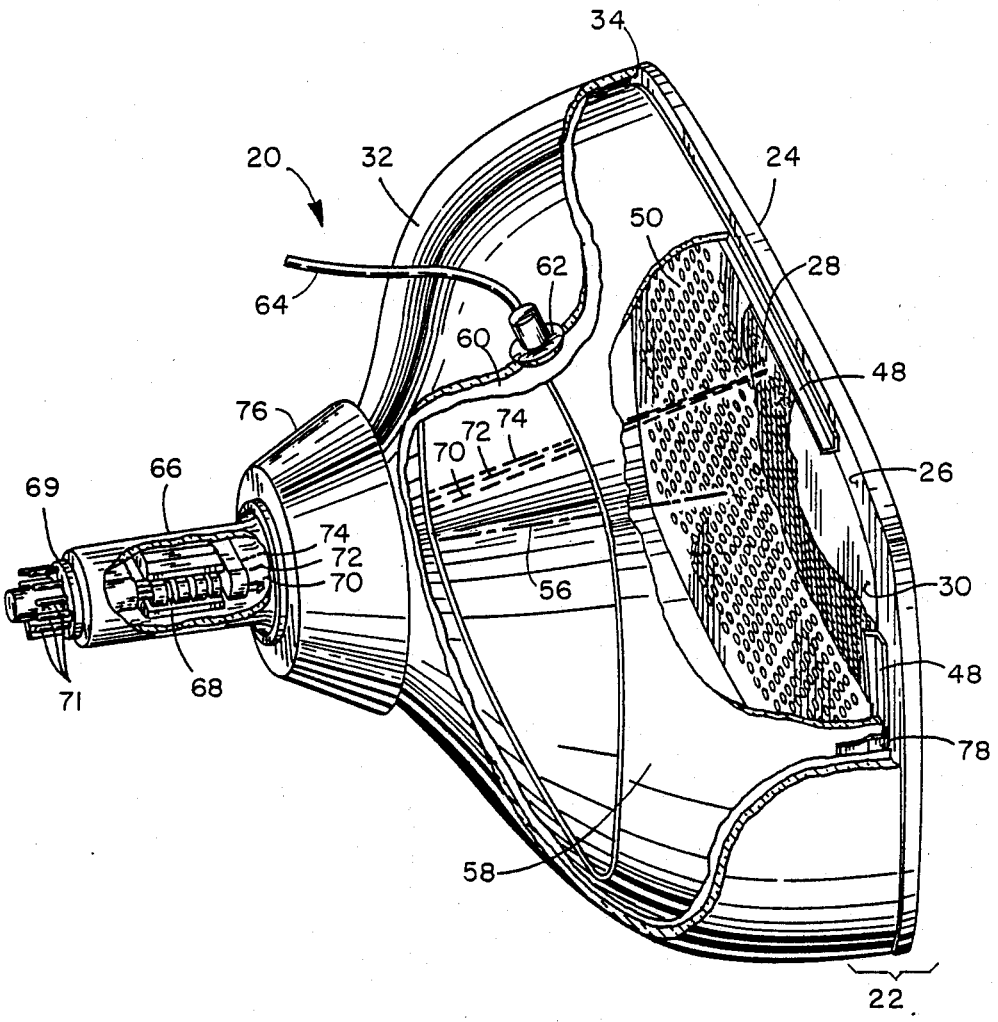
FIG. 1 is a side view in perspective of a color cathode ray tube having an improved shadow mask support structure according to the invention, with cut-away sections that indicate the location and relation of the structure to other major tube components.

A cathode ray tube having a faceplate assembly with a pre-sized mask support structure according to the inventive means and process is depicted in FIG. 1. The tube and its component parts are identified in FIGS. 1, 2 and 3, and described in the following paragraphs in this sequence: reference number, a reference name, and a brief description of structure, interconnections, relationship, functions, operation, and/or result, as appropriate.

Figure 2:
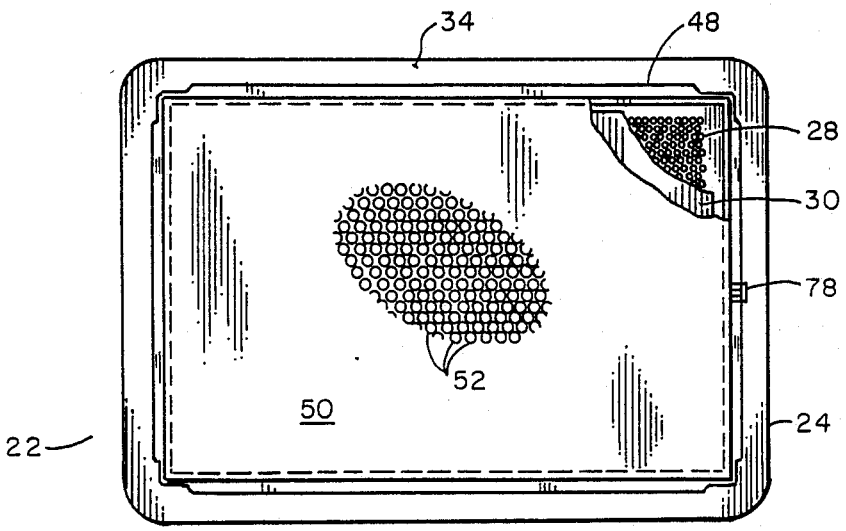
FIG. 2 is a plan view of the front assembly of the tube shown by FIG. 1, taken from the aspect of the electron gun, and with parts cut away to show the relationship of the embodiment of the mask support structure shown by FIG. 1 with the faceplate and the shadow mask; an inset depicts mask apertures greatly enlarged.
Figure 3:
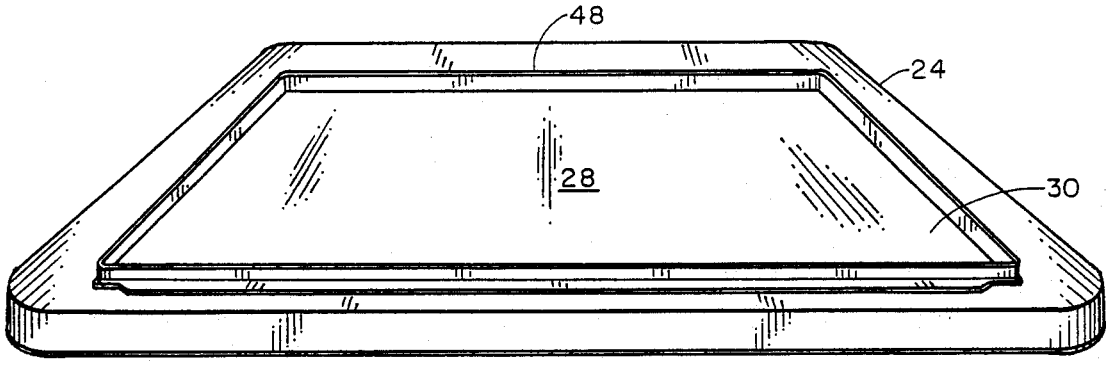
FIG. 3 is a view in perspective of the faceplate depicted in FIGS. 1 and 2, and showing in greater detail the location and orientation of a shadow mask support structure according to the invention as secured to a faceplate.

20: color cathode ray tube
22: faceplate assembly
24: glass faceplate
26: inner surface of faceplate
28: centrally disposed phosphor screen
30: film of aluminum
32: funnel
34: peripheral sealing area of faceplate 24, adapted to mate with the peripheral sealing area of funnel 32
48: frame-like shadow mask support structure according to the invention located on opposed sides of the screen 28 for receiving and securing a tensed foil shadow mask; the support structure is depicted by way of example in FIGS. 1–3 as comprising a unitary structure; that is, a one-piece structure
50: metal foil shadow mask; after being tensed, the mask is mounted on support structure 48 and secured thereto
52: shadow mask apertures, indicated as greatly enlarged in the inset in FIG. 2 for illustrative purposes
56: anterior-posterior axis of tube
58: internal magnetic shield
60: internal conductive coating on funnel
62: anode button
64: high-voltage conductor
66: neck of tube
68: in-line electron gun providing three discrete in-line electron beams 70, 72 and 74 for exciting the respective red-light-emitting, green-light-emitting, and blue-light-emitting phosphor deposits on screen 28
69: base of tube
71: metal pins for conducting operating voltages, and sweep and video signals, through base 69 to electron gun 68
76: yoke which provides for the traverse of beams 70, 72 and
74: across screen 28
78: contact spring which provides an electrical path between the funnel coating 60 and the mask support structure 48.

As indicated by FIGS. 1 and 2, a faceplate assembly 22 for a cathode ray tube 20 includes a glass faceplate 24 having on its inner surface 26 a centrally disposed phosphor screen 28. A foil shadow mask 50 is mounted in tension on a shadow mask support structure 48 located on opposed sides of screen 28, and secured to the inner surface 26. The support structure 48 is noted as having a tightly controlled uniform height.

The faceplate 24 without the shadow mask, but with a mask support structure 48 according to the invention secured to the inner surface 26, is depicted in FIG. 3. The support structure according to the invention may comprise the unitary structure framing the screen, as indicated. Alternately, it may comprise a plurality of discrete sections framing the screen (not shown). By way of example, a structure of the latter type is similar to the unitary support structure 48 depicted except that the corners are not physically connected.

Figure 4:
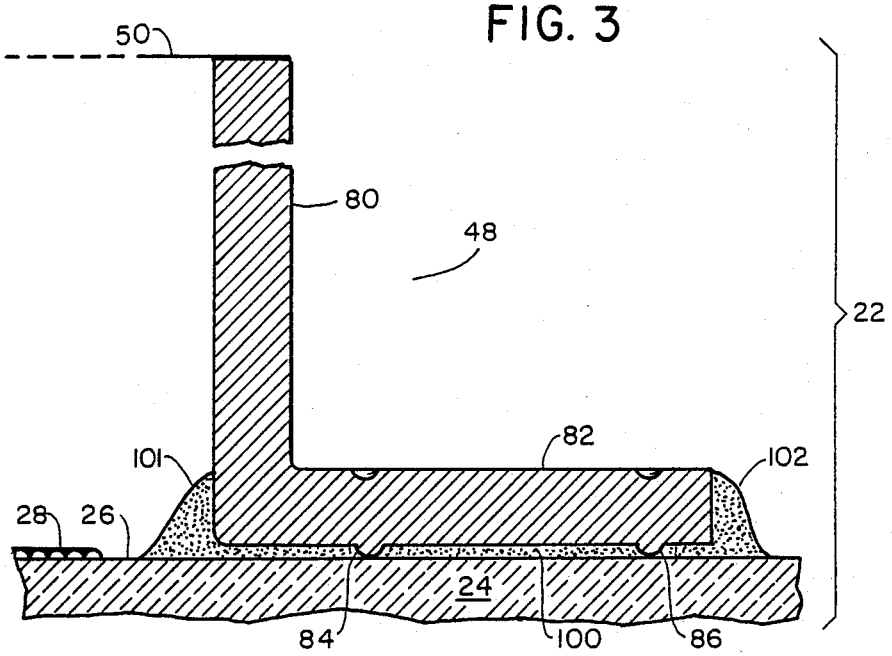
FIG. 4 is a cross-sectional view in elevation of the shadow mask support structure depicted in FIGS. 1–3 and showing spacing elements according to the invention extending from the structure in intimate contact with the inner surface of a faceplate.

With reference to FIG. 4, the shadow mask support structure 48 of the faceplate assembly 22 depicted in FIGS. 1–3 is shown in greater detail. Support structure 48 is indicated as having an L-shaped cross-section, with a first portion 80 for receiving and securing the shadow mask 50, and a second portion 82 secured to the inner surface 26 of faceplate 24 by devitrified solder glass 100, indicated schematically. The faceplate assembly 22 according to the invention is indicated as having a plurality of spacing elements also of tightly controlled uniform height located between second portion 82 of support structure 48 and the inner surface 26 of faceplate 24, and extending through solder glass 100 to provide intimate contact with inner surface 26. Two of the plurality of spacing elements are indicated by reference numbers 84 and 86. The tightly controlled uniform heights of support structure 48 and the spacing elements provide, according to the invention, for tightly controlled uniform spacing between mask 50 and screen 28 throughout the length of the structure 48. It is to be noted that the spacing elements 84 and 86 indicated are greatly exaggerated in size relative to the support structure itself for purposes of illustration; the actual height of the spacing elements is in the range of 0.004 to 0.006 inches, and preferably about 0.005 inch, by way of example.

Figure 5:
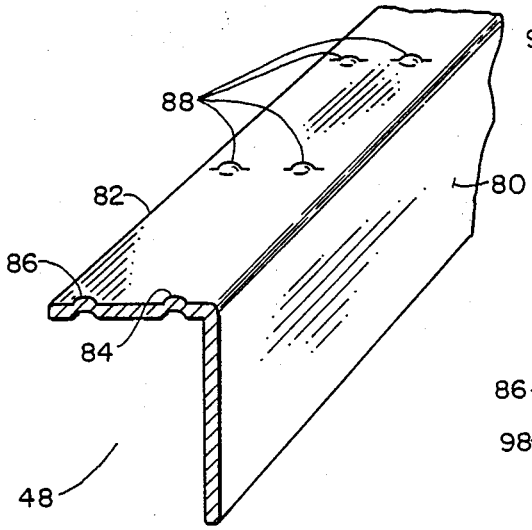
FIG. 5 is a perspective view of a section of the mask support structure depicted in FIG. 4 showing in greater detail a number of the spacing elements.

Support structure 48 is depicted as inverted in FIG. 5 to show details of the spacing elements as applied to a support structure 48 having the configuration shown. Spacing elements 84 and 86, depicted in FIG. 4, along with spacing elements 88, comprise according to the invention integral extensions projecting from the support structure 48; that is, forming a part of the material of the structure.

Figure 6:
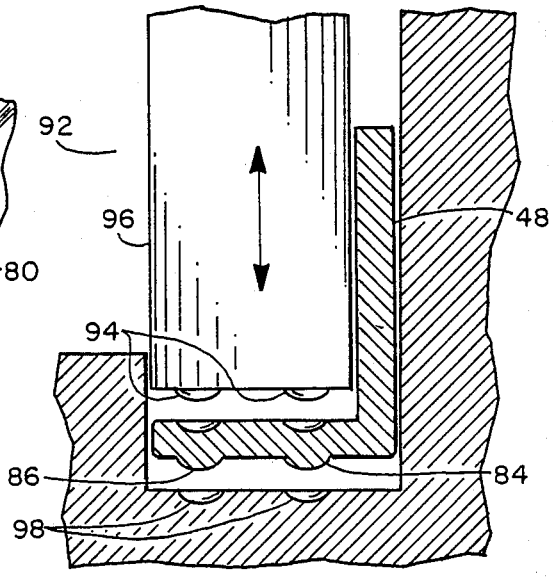
FIG. 6 is a sectional view in elevation depicting diagrammatically the forming of the mask support structure shown by FIGS. 3–5 by means of a die-set.

FIG. 6 depicts schematically a means for forming the spacing elements as integral extensions of support structure 48. As indicated, the spacing elements can readily be formed during the die-forming of the actual support structure. Die-set 92 is depicted diagrammatically in the act of forming support structure 48. At the same time, the projections 94 of punch 96, in company with the mating depressions 98 of the die set, provide embossments comprising the spacing elements 84 and 86. The spacing elements, noted as extending about 0.005 inch, can be formed with tightly controlled accuracy. Roll-forming is also a feasible method of forming a support structure having the integral extensions described.

With reference again to FIG. 4, devitrified solder glass 100, indicated schematically by the stipple pattern, provides for securing support structure 48 to the inner surface 26. The solder glass is shown as distributed between the bottom of second portion 82 and the inner surface 26, and between the spacing elements 84 and 86. Fillets 101 and 102, also comprised of devitrified solder glass, aid in the attachment of the structure to the faceplate. The spacing elements 84 and 86 are indicated as being in intimate contact with the inner surface 26 of faceplate 24.

A suitable devitrifying solder glass may comprise, by way of example, solder glass CV-685 supplied by Owens-Illinois Television Products Division of Toledo, Ohio. Solder glass products supplied by other manufacturers may as well be used provided that they have the desired properties and characteristics.

The material of the support structure preferably comprises a metal such as Alloy No. 27 manufactured by Carpenter Technology of Reading, Pa.; the material comprises an iron alloy containing 28 percent chromium; it is designed for sealing to solder glass. The alloy has a CTC (coefficient of thermal contraction) of approximately 105 to $109\times10^{-7}$ in/in/degree C. over the range of the temperatures required for devitrification—from ambient temperature to 435 degrees C. The glass of the faceplate 24 in turn has a CTC of approximately $103\times10^{-7}$/degree C. over the designated range.

By way of example, the height of a typical mask support structure, represented by first portion 80 of support structure 48, is about 0.290 inch, and the length of the second portion 82 of structure 48 that is contiguous to the glass of the faceplate is about 0.220 inch. First portion 80, the end of which is indicated as receiving a shadow mask 50, preferably has a width of at least 0.050 inch to provide an adequate surface for securing the mask. The means of mask securement is preferably by laser welding, as fully described and claimed in referent copending application Ser. No. 058,095.

The need for the spacing elements according to the invention lies in the fact that it has proved impractical to secure a support structure to a faceplate with precise and reproducible spacing between the base of the support structure and the faceplate—this despite the fact that support structures such as have been described, can be machined (ground) or otherwise precisely formed prior to installation. There is no way to predict how near or how far the bottom of the support structure will be from the faceplate without the use of spacing elements according to the invention, since the amount of spacing is dependent on such uncontrollable and unpredictable factors as thermal cycle variations, uniformity of pressure, fixture flatness, and variations in the composition of the solder glass. For example, spacing variations without spacing elements according to the invention is in the range of from 0.001 inch to as much as 0.015 inch. Another factor: some who are skilled in the art believe it is necessary to have an appreciable layer of solder glass between the two components; otherwise, too close contact between the metal of the support structure and the glass of the faceplate may result in spalling of the surface of faceplate, and possible cracking of the faceplate, even though the thermal expansion mismatch may be minor. The spacing elements according to the invention ensure proper spacing by allowing the solder glass to squeeze out during sealing only until contact with the spacing elements with the inner surface of the faceplate takes place. The result is a tightly controlled uniform height dimension of structure 48 without the need for sizing of the support structure as by grinding after its installation on the faceplate. Because the actual area of contact of each spacing element with the glass of the inner surface of the faceplate is very tiny, spalling is not induced.

A devitrifying solder glass according to the invention provides not only for securing the support structure to the inner surface of the faceplate, but also has blended therein a plurality of discrete spacing elements preferably comprising glass spheres of tightly controlled uniform diameter. The spheres provide for tightly controlled uniform spacing between the support structure and the inner surface.

Figure 7:
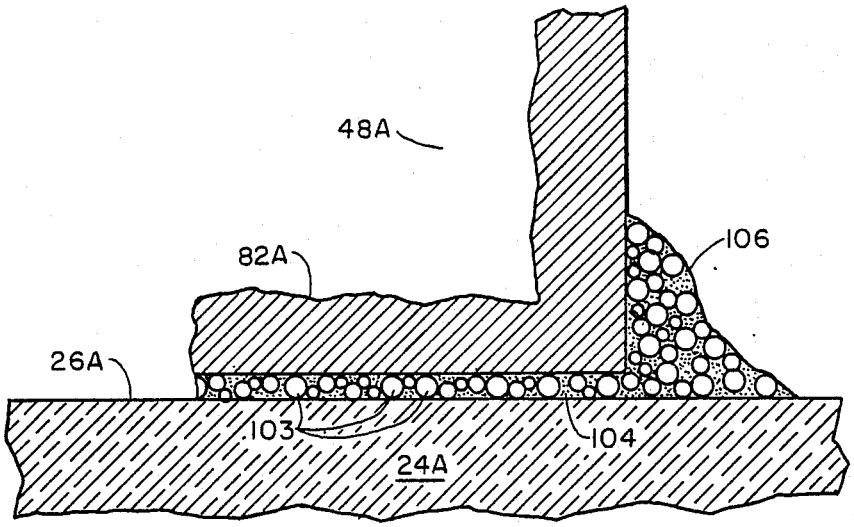
FIG. 7 is a sectional view in elevation, greatly enlarged, of a corner section of mask support structure, and showing details of the location of novel spacing elements according to the invention in relation to the structure.

An embodiment of the invention in which a mask support structure is secured to, and spaced from, the inner surface of a faceplate by solder glass with a blend of glass spheres is shown diagrammatically by FIG. 7, noted as being not to scale. The support structure 48A depicted is identical to support structure 48 described heretofore, except that it has no integral spacing elements projecting from its second portion 82A. Instead, the spacing elements are indicated diagrammatically as comprising spheres 103 dispersed between the second portion 82A of support structure 48A and the inner surface 26A of faceplate 24A.

A devitrifying solder glass according to the invention has blended therein a plurality of discrete spacing elements comprising spheres of tightly controlled uniform height to provide tightly controlled uniform spacing between the mask support structure and the inner surface of the faceplate to which it is attached.

The spheres 103, which are also called "microspheres," may comprise, by way of example, spheres of soda-lime silica glass having a range of predetermined diameters, the largest of which may be a diameter of 0.005 inch, again by way of example. Such spherical elements are be manufactured inexpensively and in quantity to tolerances of a few microns. Spheres having a diameter of 130 microns provide an exact spacing of 0.0051 inch. If greater spacing is required, spheres having a diameter of 150 microns will provide a spacing of 0.0059 inch, by way of example.

Spherical elements suitable for the application described are available from Jayco, located in Mahwah, N.J., under the designation "0.11 beads"; this group has a size distribution of 90 to 130 microns. Spheres of the largest diameter—130 microns (0.005 inch) serve as the spacing elements. Potter Industries of Hasbrouck, N.J. is another source; their designation is "No. 2227 beads," and the size range is 75 to 150 microns (0.0059 inch).

With reference again to FIG. 7, the spheres 103, noted as being distributed randomly between second portion 82A of support structure 48A and the inner surface 26A of faceplate 24A, are dispersed, according to the invention, in the devitrified solder glass 104 used for the securement of support structure 48A to the inner surface 26A of the faceplate 24A. The fact of random distribution of the spheres 103 is attributable to their being made a component of the solder glass 104, which is indicated symbolically by the stipple pattern. The fact that the spacing elements are spherical ensures that the spacing elements do not pile up, and so double or triple the required spacing. Fillet 106, which aids in the attachment of the support structure to the faceplate, will be noted as also having spheres therein because of the mixture of spheres and solder glass paste, as described.

A suitable composition is achieved by thoroughly blending suitable spheres with a devitrifying solder glass paste in a ratio of one to 99, or one ounce of spheres to 99 ounces of solder glass paste, or 1 percent spheres in the solder glass seal. The devitrifying solder glass preferably comprises a composition having a relatively low viscosity when in paste form, such as the solder glass supplied by Corning Glass Works of Corning, New York, under the designation "7580." The mixture described provides a population of about one million spheres for each support structure installation, so statistically, there will always be an adequate distribution of spheres of the largest, desired diameter in the solder glass to ensure proper spacing. Spheres of a smaller, undesired size, which will be noted in FIG. 7 as lying among spheres 103 of desired size, and which only tend to "pollute" the solder glass-sphere mixture, may be sieved out.

The benefit of using spheres as spacing elements according to the invention is three-fold: (1) No post-installation sizing of the support structure, such as by grinding, is needed; (2), the spheres are inexpensive—the cost is of the order of a couple of cents per installation; and (3), a high order of accuracy in spacing is attained.

Figure 8:
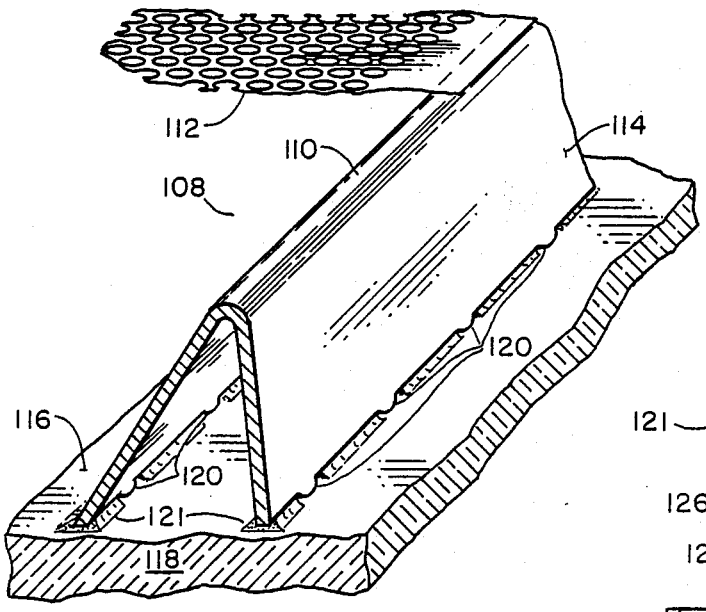
FIG. 8 is a perspective view of a section of a V-shaped mask support structure showing the location of spacing elements according to the invention adapted to a structure of this type.

Another foil shadow mask support structure which may be configured to provide a uniform height dimension according to the invention, is depicted in FIG. 8; the basic structure is fully described and claimed in reference U.S. Pat. No. 4,695,761, of common ownership herewith. Support structure 108 is indicated as having in cross-section the shape of an inverted "V", and having a first portion 110 for receiving and securing a shadow mask 112, and a second portion 114 consisting of two legs for attachment to the inner surface 116 of a faceplate 118. A plurality of integral spacing elements 120 of tightly controlled height are indicated as projecting from each leg of support structure 108, and extending through solder glass 121 to provide contact with inner surface 116 of faceplate 118.

Figure 8A:
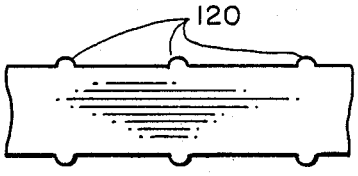
FIG. 8A is a plan view of an the V-shaped mask support structure of FIG. 8 showing details the formation of the spacing elements according to the invention during manufacture.

The support structure 108, depicted symbolically as being a metal, is preferably formed from Carpenter Alloy No. 27. The support structure with integral spacing elements may be shaped with great precision by a die-set formed by wire EDM (electric discharge machining), a manufacture process well-known in the art. As indicated by FIG. 8A, the die forms a flat blank having spacing elements 120 projecting therefrom. The blank is then machine-rolled into the desired V-shape indicated by FIG. 8.

Figure 9:
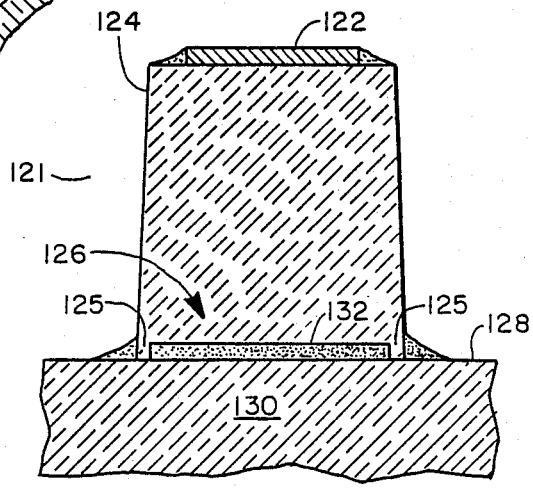
FIG. 9 is a sectional view in elevation of an embodiment of a ceramic support structure showing the location and shape of integral spacing elements according to the invention in relation to the structure.

A ceramic foil mask support structure having spacing elements according to the invention is depicted in FIG. 9; the basic configuration; that is, the configuration without spacing elements according to the present invention, is fully described and claimed in referent U.S. Pat. No. 4,737,681 of common ownership herewith. Support structure 121 is indicated as havinq a metal cap or strip 122 secured to a first portion 124 of the structure for receiving and securing a foil shadow mask (not indicated). Support structure 121 is shown as having spacing elements 125 according to the invention, noted as being integral extensions of the structure, and projecting from a second portion 126 of structure 121 for intimately contacting the inner surface 128 of faceplate 130. Attachment of the support structure 121 to the inner surface 128 is preferably by means of devitrified solder glass 132, indicated symbolically by the stipple pattern.

Ceramic support structure 121 is preferably formed by an extrusion process, as described in the referent '681 Patent. The spacing elements 125 are readily formed by an extrusion mold, and comprise elements that run the full length of the support structure. As indicated by FIG. 9, the spacing elements 125 are relatively narrow, and readily "knife through" or otherwise penetrate the solder glass 132 when in it is in paste form. The result is that the spacing elements come into intimate contact with the inner surface 128.

In lieu of the integral spacing elements 125 indicated in FIG. 9, support structure 121 may as well be spaced from the inner surface of a faceplate by means of discrete spacing entities comprising spheres, as described in connection with the support structure configuration depicted in FIG. 7. It is noted almost that most shadow mask support structure configurations having a flat bottom section (unlike the V-shape structure depicted in FIG. 8) will lend themselves to spacing by spheres dispersed in solder glass when the solder glass is in paste form, all according to the invention.

A process according to the invention for use in the manufacture of a color cathode ray tube having a faceplate assembly with a substantially flat faceplate and a tensed foil shadow mask spaced thereform, comprises:

providing a frame-like shadow mask support structure and forming the structure to have a tightly controlled uniform height throughout its length;

providing a faceplate having a centrally disposed phosphor screening area on its inner surface;

locating spacing elements of tightly controlled uniform height between the support structure and the inner surface of the faceplate;

locating a layer of devitrifying solder glass paste between the support structure and the inner surface of the faceplate;

positioning the support structure so as to enclose the screening area;

pressing the support structure into the solder glass paste to force the spacing elements through the paste into intimate contact both with the support structure and the inner surface of the faceplate;

heating the faceplate and the support structure to a temperature effective to devitrify the solder glass paste and permanently secure the support structure to the faceplate;

forming a screen by depositing a predetermined pattern of colored-light-emitting phosphors on the screening area;

securing in tension to the support structure a foil shadow mask having apertures in correlation with the predetermined pattern on the screening area.

As a result of the inventive process, the tightly controlled uniform heights of both the support structure and the spacing elements provide for tightly controlled uniform spacing between the mask and the screen.

Also according to the inventive process, the spacing elements may comprise integral spacing elements of tightly controlled uniform height extended from the support structure, and pressed through the devitrifying solder glass paste into intimate contact with the inner surface of the faceplate.

Also in accord with the inventive process, the spacing elements may comprise blending a predetermined plurality of discrete spacing elements of tightly controlled uniform height into a devitrifying solder glass paste to form an adhering-spacing compound. The support structure is pressed into the adhering-spacing compound to force the spacing elements in the compound into intimate contact with both the support structure and the inner surface of the faceplate. The spacing elements may comprise glass spheres of tightly controlled uniform diameter blended into the solder glass paste to provide the adhering-spacing compound. It is noted that in order to utilize the adhering-spacing compound effectively, the surface of the support structure nearest the faceplate must be substantially flat.

Following the solder glass paste dispensing step described in the foregoing, the support structure is inserted in a lehr where it is heated to a maximum temperature of 450 degrees C. for a period of one hour. The temperature and time duration cited is adequate to devitrify the solder glass. In the final sealing process, in which the faceplate is sealed to the funnel—also by means of a devitrifying solder glass paste—a lehr is again used with the same heating cycle.

Figure 10:
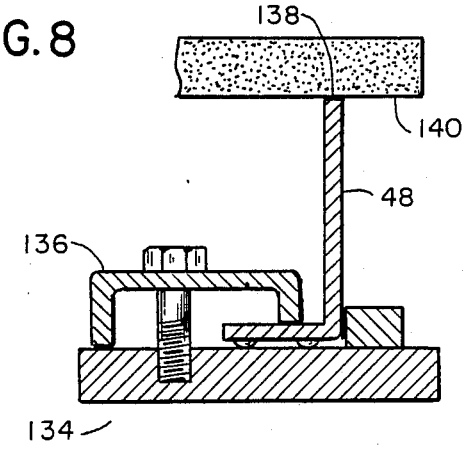
FIG. 10 is a sectional view in elevation depicting schematically a fixture for pre-sizing the mask-receiving surface of a support structure.

It may be necessary to machine certain support structure configurations prior to attachment to the inner surface of a faceplate to provide a uniform height dimension. An example is shown diagrammatically by FIG. 10, wherein the configuration of the support structure 48 depicted in FIGS. 1–7 is indicated as being ground to proper height. The support structure 48 is preferably held in a holding fixture 134 by clamping means 136, indicated diagrammatically. The top face 138 of structure 48 is indicated as being ground by abrasive wheel 140 to form structure 48 to the proper tightly controlled height; grinding also forms a flat surface suitable for receiving a shadow mask. It is also entirely possible that an L-shaped support structure of this type can be formed so precisely that pre-sizing as by grinding is unnecessary.

With regard to the machining of a support structure that does not have integral extensions for spacing elements, such as support structure 48 depicted in FIG. 7, it is desirable to finish-grind both the surface for receiving and securing the shadow mask, and the surface that is contiguous to the inner surface of faceplate; these surfaces must be completely flat and precision-finished. A structure of this type must not only be finish-ground, but it may also be necessary to grind it to a dimension that, together with the diameter of the spherical spacing elements, equals the desired tightly controlled height of the structure, and thus provides a uniform distance from the mask from the screen. The structure must be controlled in height to within 0.002 inch so that, in combination with glass errors of about 0.003 inch, the total error will not exceed 0.005 inch. The fixturing and grinding of foil shadow mask support structures is described and claimed in referent copending application Ser. No. 140,464. While the '464 disclosure is directed to the machining of support structures already secured to the faceplate, many of the procedures of grinding, machining, and fixturing described are applicable to the support structures of the present invention.

The spacing elements according to the present invention make it possible to pre-size a support structure; that is, before it is secured to the faceplate. The benefits include a simplification of the manufacturing process, with attendant cost savings, since it is unnecessary to grind an installed support structure to size, and in the case of accurately preformed support structures described heretofore, no grinding may be required whatsoever. Also, less of the costly alloy No. 27 is required, and there is less handling of the delicate glass faceplates, so there is less loss due to damage.

While particular embodiments of the invention have been shown and described, it will be readily apparent to those skilled in the art that changes and modifications may be made in the inventive means and process without departing from the invention in its broader aspects, and therefore, the aim of the appended claims is to cover all such changes and modifications as fall within the true spirit and scope of the invention.

What is claimed is:

1. A faceplate assembly for a color cathode ray tube including a glass faceplate having on its inner surface a centrally disposed phosphor screen, and a foil shadow mask mounted in tension on a mask-support structure of tightly controlled uniform height extending between said mask and said faceplate which is located on opposed sides of said screen and secured to said inner surface by a layer of devitrified solder glass, said assembly having spacing elements also of tightly controlled uniform height located between said support structure and said inner surface of said faceplate, and extending through said layer of solder glass to provide intimate contact with said inner surface, whereby the tightly controlled uniform heights of said support structure and said spacing elements provide for tightly controlled uniform spacing between said mask and said screen throughout the length of said support structure.

2. The faceplate assembly according to claim 1 wherein said spacing elements comprise integral extensions projecting from said support structure.

3. The faceplate assembly according to claim 1 wherein said spacing elements comprise a plurality of discrete spacing elements located between said support structure and said inner surface of said faceplate, and in intimate contact both with said support structure and said inner surface.

4. The faceplate assembly according to claim 3 wherein said plurality of discrete spacing elements are dispersed in devitrified solder glass.

5. The faceplate assembly according to claim 3 wherein said plurality of discrete spacing elements comprises spheres having a tightly controlled uniform diameter.

6. The faceplate assembly according to claim 5 wherein said spheres comprise glass.

7. The faceplate assembly according to claim 1 wherein said support structure comprises a unitary structure framing said screen.

8. The faceplate assembly according to claim 1 wherein said support structure comprises a plurality of discrete sections framing said screen.

9. A faceplate assembly for a color cathode ray tube including a glass faceplate having on its inner surface a centrally disposed phosphor screen, and a foil shadow mask mounted in tension on a mask-support structure of tightly controlled uniform height extending between said mask and said faceplate which is located on opposed sides of said screen and secured to said inner surface by a layer of devitrified solder glass, said assembly having spacing elements also of tightly controlled uniform height comprising integral extensions projecting from said support structure and extending through said layer of solder glass to provide intimate contact with said inner surface, whereby the tightly controlled uniform heights of said support structure and said spacing elements provide for tightly controlled uniform spacing between said mask and said screen throughout the length of said support structure.

10. A faceplate assembly for a color cathode ray tube including a glass faceplate having on its inner surface a centrally disposed phosphor screen, and a foil shadow mask mounted in tension on a mask-support structure of tightly controlled uniform height extending between said mask and said faceplate which is in the shape of an inverted "V" located on opposed sides of said screen and secured to said inner surface by a layer of devitrified solder glass, said assembly having spacing elements also of tightly controlled uniform height comprising integral extensions projecting from each leg of said support structure and extending through said layer of solder glass to provide intimate contact with said inner surface, whereby the tightly controlled uniform heights of said support structure and said spacing elements provide for tightly controlled uniform spacing between said mask and said screen throughout the length of said support structure.

11. A faceplate assembly for a color cathode ray tube including a glass faceplate having on its inner surface a centrally disposed phosphor screen, and a foil shadow mask mounted in tension on a mask-support structure of tightly controlled uniform height located on opposed sides of said screen and secured to said inner surface by devitrified solder glass, said assembly having spacing elements dispersed in said solder glass comprising a plurality of discrete spacing elements of tightly controlled uniform height located between, and in intimate contact with both said support structure and said inner surface of said faceplate, whereby the tightly controlled uniform heights of said support structure and said spacing elements dispersed in said solder glass provide for tightly controlled uniform spacing between said mask and said screen throughout the length of said support structure.

12. The faceplate assembly according to claim 11 wherein said plurality of discrete spacing elements comprises spheres having a predetermined common diameter.

13. The faceplate assembly according to claim 12 wherein said spheres are glass.

14. A faceplate assembly for a color cathode ray tube including a glass faceplate having on its inner surface a centrally disposed phosphor screen, and a foil shadow mask mounted in tension on a mask-support structure of tightly controlled uniform height located on opposed sides of said screen and secured to said inner surface by devitrified solder glass, said assembly having spacing elements comprising discrete glass spheres of tightly controlled uniform diameter dispersed in said solder glass, and in intimate contact both with said support structure and said inner surface of said faceplate, whereby the tightly controlled uniform height of said support structure and the tightly controlled uniform diameters said spacing elements dispersed in said solder glass provide for tightly controlled uniform spacing between said mask and said screen throughout the length of said support structure.

15. A devitrifying solder glass for use in a faceplate assembly for a color cathode ray tube including a glass faceplate having on its inner surface a centrally disposed phosphor screen, and a foil shadow mask mounted in tension on a mask-support structure of tightly controlled uniform height located on opposed sides of said screen, said solder glass providing for securing said support structure to said inner surface and having blended therein a plurality of discrete spacing elements comprising spheres of tightly controlled uniform diameter to provide tightly controlled uniform spacing between said structure and said inner surface, whereby the tightly controlled uniform height of said support structure and the tightly controlled uniform diameter said spacing elements blended in said solder glass provide for tightly controlled uniform spacing between said mask and said screen throughout the length of said support structure.

16. The devitrifying solder glass according to claim 15 wherein said spheres of tightly controlled uniform diameter are spheres of glass.

17. For use in the manufacture of a color cathode ray tube having a faceplate assembly with a faceplate and a tensed foil shadow mask, a process comprising:

providing a frame-like shadow mask support structure and forming said structure to have a tightly controlled uniform height throughout its length;

providing a faceplate having a centrally disposed phosphor screening area on its inner surface;

locating spacing elements of tightly controlled uniform height between said support structure and said inner surface of said faceplate;

locating a layer of devitrifying solder glass paste between said support structure and said inner surface of said faceplate;

positioning said support structure so as to enclose said screening area;

pressing said support structure into said solder glass paste to force said spacing elements through said paste into intimate contact both with said support structure and said inner surface of said faceplate;

heating said faceplate and said support structure to a temperature effective to devitrify said solder glass paste and permanently secure said support structure to said faceplate;

forming a screen by depositing a predetermined pattern of colored-light-emitting phosphors on said screening area; and, securing in tension to said a a foil shadow mask having apertures in correlation with said predetermined pattern on said screen;

whereby the tightly controlled uniform heights of said support structure and said spacing elements provide for tightly controlled uniform spacing between said mask and said screen.

18. For use in the manufacture of a color cathode ray tube having a faceplate assembly with a faceplate and a tensed foil shadow mask, a process comprising:

providing a frame-like shadow mask support structure having a first surface for receiving and securing a shadow mask, and a second surface for attachment to the inner surface of a faceplate;

providing a faceplate having a centrally disposed phosphor screening area on its inner surface;

extending integral spacing elements of tightly controlled uniform height from said second surface of said support structure;

forming said structure with said spacing elements extending therefrom to have a tightly controlled uniform height throughout its length;

locating a layer of devitrifying solder glass paste between said second surface of said support structure and said inner surface of said faceplate;

enclosing said screening area within said support structure;

pressing said support structure into said solder glass paste to force said spacing elements through said paste into intimate contact with said inner surface of said faceplate;

heating said faceplate and said support structure to a temperature effective to devitrify said solder glass paste and permanently secure said support structure to said faceplate;

forming a screen by depositing a predetermined pattern of colored-light-emitting phosphors on said screening area;

securing in tension to said support structure a foil shadow mask having apertures in correlation with said predetermined pattern of said screen;

whereby the combined tightly controlled uniform heights of said support structure and said spacing elements in intimate contact with said inner surface provide for tightly controlled uniform spacing between said mask and said screen.

19. For use in the manufacture of a color cathode ray tube having a faceplate assembly with a faceplate and a tensed foil shadow mask, a process comprising:

providing a frame-like shadow mask support structure having a first surface for receiving and securing a shadow mask, and a second, flat surface opposite to said first surface for attachment to the inner surface of a faceplate;

forming said structure to have a tightly controlled uniform height throughout its length;

providing a faceplate having a centrally disposed phosphor screening area on its inner surface;

blending a predetermined plurality of discrete spacing elements of tightly controlled uniform height into a devitrifying solder glass paste to form an adhering-spacing compound;

locating a layer of said adhering-spacing compound between said second surface of said support structure and said inner surface of said faceplate;

enclosing said screening area within said support structure;

pressing said support structure into said adhering-spacing compound to force said spacing elements of said compound into intimate contact both with said second, flat surface of said support structure and said inner surface of said faceplate;

heating said faceplate and said support structure to a temperature effective to form a devitrified solder glass permanently securing said support structure to said faceplate;

forming a screen by depositing a predetermined pattern of colored-light-emitting phosphors on said screening area;

securing in tension to said support structure a foil shadow mask having apertures in correlation with said predetermined pattern of said screen;

whereby the tightly controlled uniform heights of said support structure and said discrete spacing elements contained in said devitrified solder glass provide for tightly controlled uniform spacing between said mask and said screen.

20. The process according to claim 19 comprising blending glass spheres of tightly controlled uniform diameter into said solder glass paste to provide said adhering-spacing compound.

* * * * *